US008702399B2

(12) United States Patent
Krohn

(10) Patent No.: US 8,702,399 B2
(45) Date of Patent: Apr. 22, 2014

(54) PUMP APPARATUS

(75) Inventor: Mark Krohn, Caboolture (AU)

(73) Assignee: Pentair Valves & Controls US LP, Golden Valley, MN (US)

( * ) Notice: Subject to any disclaimer, the term of this patent is extended or adjusted under 35 U.S.C. 154(b) by 1609 days.

(21) Appl. No.: 11/576,734

(22) PCT Filed: Oct. 7, 2005

(86) PCT No.: PCT/AU2005/001550

§ 371 (c)(1),
(2), (4) Date: May 9, 2007

(87) PCT Pub. No.: WO2006/037186

PCT Pub. Date: Apr. 13, 2006

(65) Prior Publication Data

US 2008/0075606 A1 Mar. 27, 2008

(30) Foreign Application Priority Data

Oct. 8, 2004 (AU) ..... 2004905801

(51) Int. Cl.
*F04F 5/24* (2006.01)

(52) U.S. Cl.
USPC ..... 417/188; 417/87

(58) Field of Classification Search
USPC ..... 417/87, 118, 86, 137, 145, 182, 188, 417/512
See application file for complete search history.

(56) References Cited

U.S. PATENT DOCUMENTS

| | | | | |
|---|---|---|---|---|
| 2,400,651 | A | 5/1946 | Marsh | |
| 3,558,240 | A * | 1/1971 | Snodgrass | 417/174 |
| 3,861,830 | A * | 1/1975 | Johnson | 417/149 |
| 4,158,576 | A * | 6/1979 | Butz | 134/7 |
| 4,341,492 | A * | 7/1982 | Montgomery et al. | 406/130 |
| 4,511,291 | A | 4/1985 | Quates, Sr et al. | |
| 4,770,610 | A | 9/1988 | Breckner | |
| 5,007,803 | A | 4/1991 | DiVito et al. | |
| 5,011,376 | A * | 4/1991 | Henriksson et al. | 417/145 |
| 5,234,037 | A * | 8/1993 | Derby | 141/67 |
| 5,749,711 | A | 5/1998 | Park | |
| 5,938,408 | A | 8/1999 | Krichbaum | |
| 6,224,345 | B1 | 5/2001 | Dussault | |
| 6,264,434 | B1 | 7/2001 | Frank | |

FOREIGN PATENT DOCUMENTS

| | | |
|---|---|---|
| AU | 706273 | 10/1994 |
| GB | 1305205 | 1/1973 |
| GB | 2267315 | 12/1993 |
| JP | 6-330899 | 11/1994 |

* cited by examiner

*Primary Examiner* — Charles Freay
*Assistant Examiner* — Philip Stimpert
(74) *Attorney, Agent, or Firm* — Quarles & Brady LLP

(57) ABSTRACT

A Pump consisting of a pressure vessel (50), an inlet nozzle (51), an ejector nozzle (52) by which vacuum and pressure are applied, and an outlet nozzle (53). The inlet and outlet nozzles (51, 52) are selectively closed by interconnected knife gate valves, operated in tandem by a pneumatic cylinder whereby when one valve is closed, the other is open an vice-versa. An ejector valve located in the ejector nozzle (52) alternately creates vacuum and generate air flow through the vessel (50). The air from the ejector is introduced into the discharge line after closure of the outlet valve.

24 Claims, 6 Drawing Sheets

PUMP APPARATUS

FIELD OF THE INVENTION

This invention relates to pump apparatus.

This invention has particular but not exclusive application to pump apparatus for pumping wet slurries of drilling particulates, and for illustrative purposes reference will be made to such application. However, it is to be understood that this invention could be used in other applications, such as the pumping of liquids and wet or dry entrainable particulates generally, such as transporting wet, damp or dry solids, muddy products, slurries and liquids and grains.

BACKGROUND OF THE INVENTION

Drilling for exploration and recovery is often done using drilling fluids to entrain the drill chips. Drill chippings may be screened out of the fluids either to recover the fluids for recycling for their own value or to simply maintain water balance. In either case there remain the drill chippings that form a slurry or wet gravel of chippings of varying fluidity. These chippings need to be moved about. The chippings form a mass that is almost invariably highly abrasive, and possibly hot and chemically reactive.

Conventionally such products are moved by augers and conveyors. This has the disadvantage of the material not being highly constrained, and the apparatus have a high maintenance impost. Pumps of the impeller and diaphragm type are less than suitable due to the moving parts coming into contact with the abrasive mixtures, resulting in for example impeller and/or valve wear.

There is accordingly a need for a pump for such materials that has substantially no moving parts in contact with the materials to avoid or substantially ameliorate wear thereto.

SUMMARY OF THE INVENTION

This invention in one aspect resides broadly in pump apparatus including:

a housing having an inlet for admitting to the housing a material to be pumped, and a delivery outlet;

a valve on each of said inlet and said outlet;

control means adapted to selectively open and close respective said valves;

pressure reduction means under the control of said control means and adapted to reduce the pressure in said housing while said inlet valve is open to admit said material to said housing, said control means being adapted to close said inlet gate means on admission of a selected charge of said material to said housing;

pressurizing means under the control of said control means and adapted to increase the pressure in said housing while said outlet valve is open to discharge said material from said housing.

The housing may be any suitable pressure vessel. The inlet and outlet valves preferably comprise a gate-type valve for robustness. For example the valves may each comprise a knifegate valve. The valves are preferably pneumatic in operation for the reasons given hereinafter. The valves may be mechanically interconnected to effect the cyclic operation of the respective valves or may be separately controlled by the control means. The control means may be electronic or may be mechanical. The control means may control the amount of material admitted to the housing for each cycle by any suitable means. For example the charge may be determined on an empirically determined time basis having regard to the nature of the material. Alternatively, the charge may be metered by weight, where a transducer or the like cooperates with the control means, or by volume, such as by a paddlewheel in the inlet supply.

The pressure reduction means may take any suitable form. Preferably the pressure reduction means driven by a source of compressed air. By this means the apparatus may be made independent of any other power supply, with the compressed air being the source of pressure reduction, pressurization and operation of the valves as described above.

The inlet may be associated with a storage means for accumulating product prior to pumping. The system is capable of drawing a head of product. However it is preferred that the material be delivered from a hopper in order to provide some gravity-assist and to minimize the mean free path for air through the product, thus maximizing the vacuum efficiency.

In particular embodiments of the present invention the pressure reduction means comprises a venturi or the like.

In a first embodiment of the invention, the compressed air generates a vacuum via an ejector which evacuates the air from the housing through a fluid connection and this in turn sucks the product into the housing when the inlet valve is opened. When the inlet valve is closed, the same source then pressurises the housing and therefore empties the housing when the outlet valve is opened. For solid matter conveying, the vacuum generated by the ejector may create a continuous airflow that travels from the collection nozzle through the pipe and pressure vessel. This operation is commonly referred as a vacuum conveying system and depending on the ratio of air to solids it can be classified as dense phase or diluted phase, the unit generates a high enough vacuum and airflow which allows the system to move between the two phases.

This property of allowing air to entrain the product allows for products to be sucked (conveyed) for vertical distances of better than 10.33 meters.

The use of high-pressure compressed air to impel the product out of the tank allows discharging the product over great distances.

In an alternative embodiment, the principle of using a combination of vacuum to load the pressure vessel and pressure to discharge it is developed further. Again, the compressed air generates the vacuum via an ejector when required to draw in the product through the inlet, and uses itself as compressed air to empty it.

During the vacuum generating cycle the exhaust air may be used to complete the discharge by cleaning the discharge pipe of any product that could have been left behind during the discharge cycle.

In a further embodiment of the invention the pressure vessel may be oriented vertically and, to maximize the benefit associated with this an, internal cone may be fitted. This may align with a relocated discharge point in the centre of a dished lower end of the vessel. There may also be an air inlet socket which gives the option of educting the material from the tank on the discharge cycle. The internal neck of the ejector penetration may be lengthened to ensure minimum carry over of product between the material inlet and the air being evacuated via the ejector module.

The vessel orientation being vertical allows for a much wider range in the moisture content of any material being recovered and transferred.

BRIEF DESCRIPTION OF THE DRAWINGS

In order that this invention may be more readily understood and put into practical effect, reference will now be made to the accompanying drawings which illustrate a preferred embodiment of the invention and wherein.

DETAILED DESCRIPTION

Figure 2:
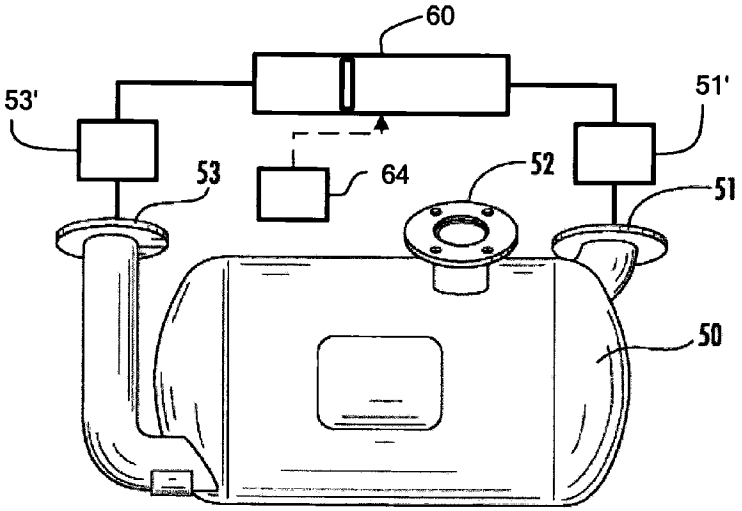
FIGS. 1 to 4 are orthogonal views of a vacuum/pressure tank suitable for use in a first embodiment of the present invention.
Figure 4:
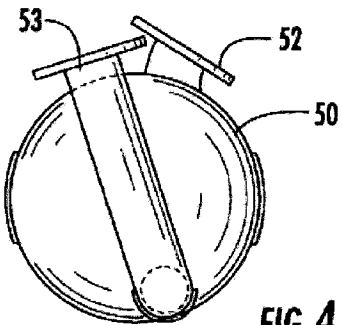
Figure 1:
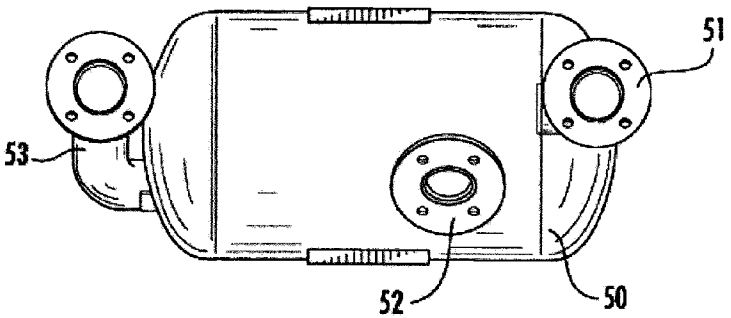
Figure 3:
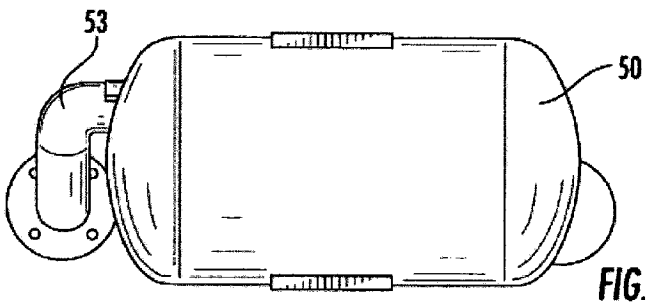
Figure 5:
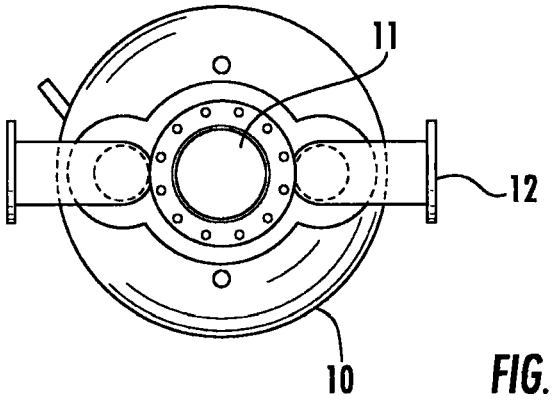
FIGS. 5 to 7 are orthogonal views of a vacuum/pressure tank suitable for use in a second embodiment of the present invention.
Figure 6:
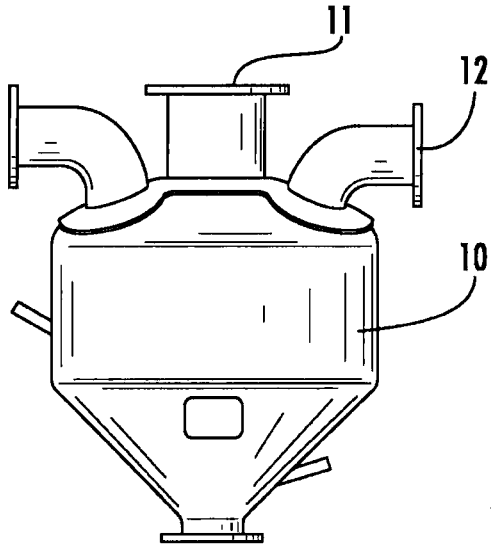
Figure 7:
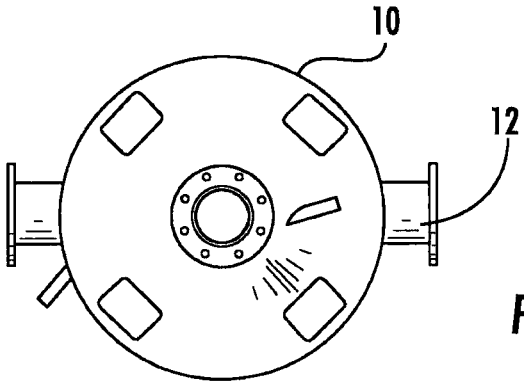
Figure 8:
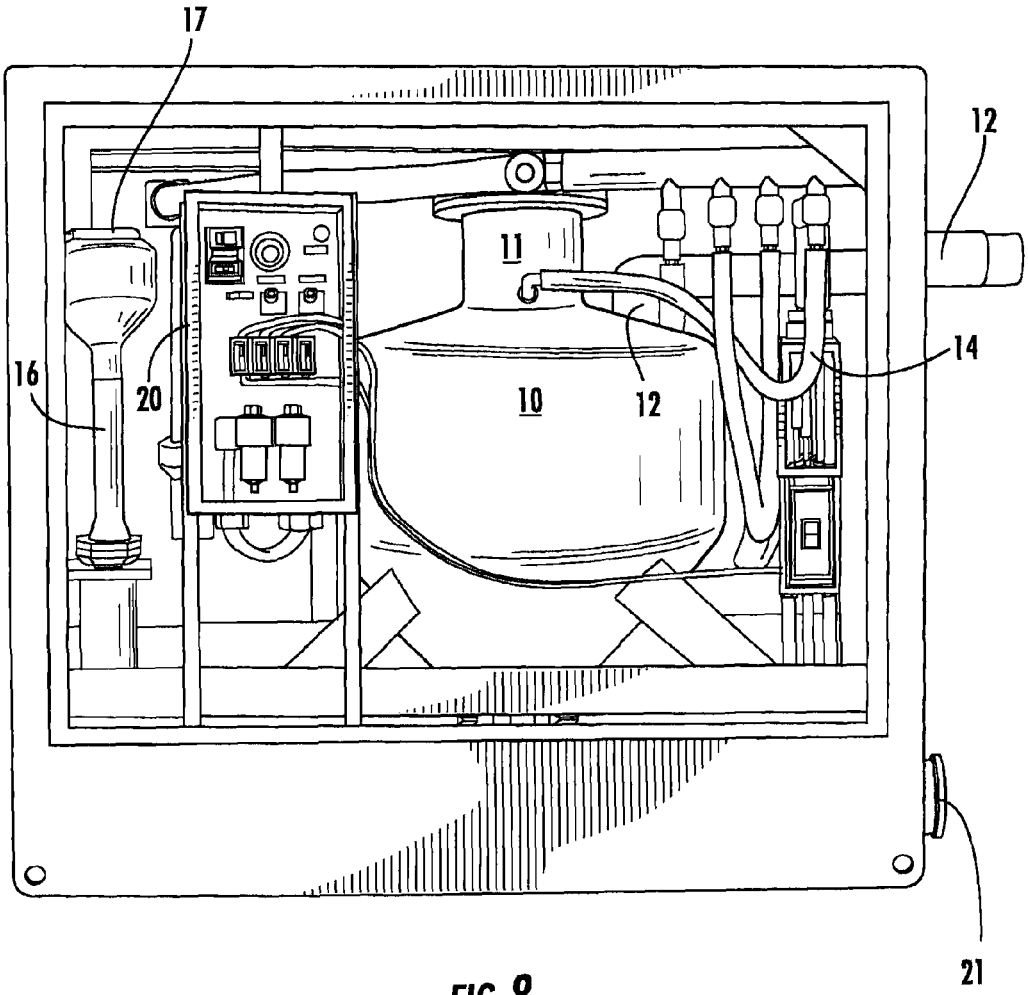
FIG. 8 is a front view of the apparatus of FIGS. 5 to 7.
Figure 9:
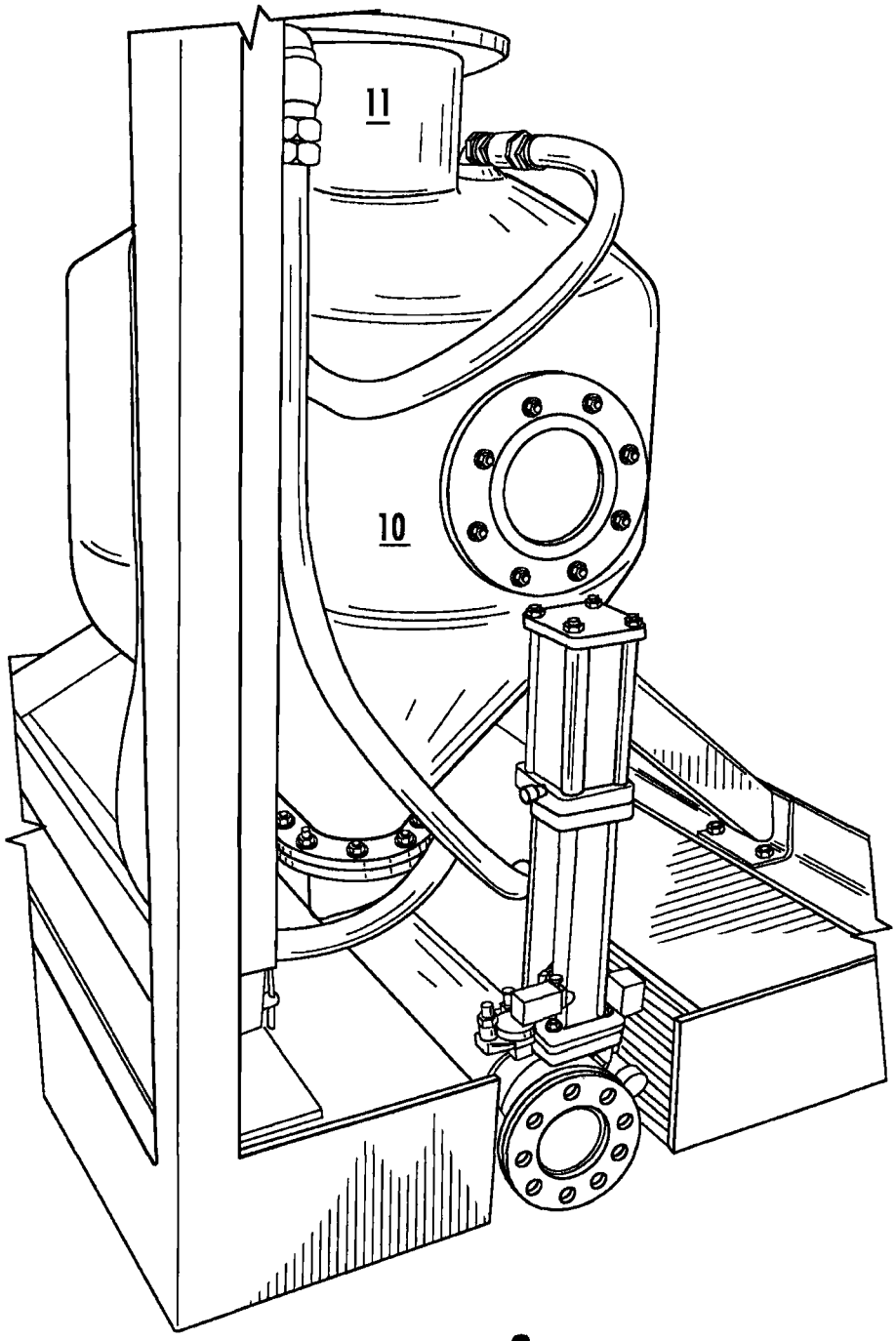
FIG. 9 is a discharge end perspective view of the apparatus of FIGS. 5 to 7.
Figure 10:
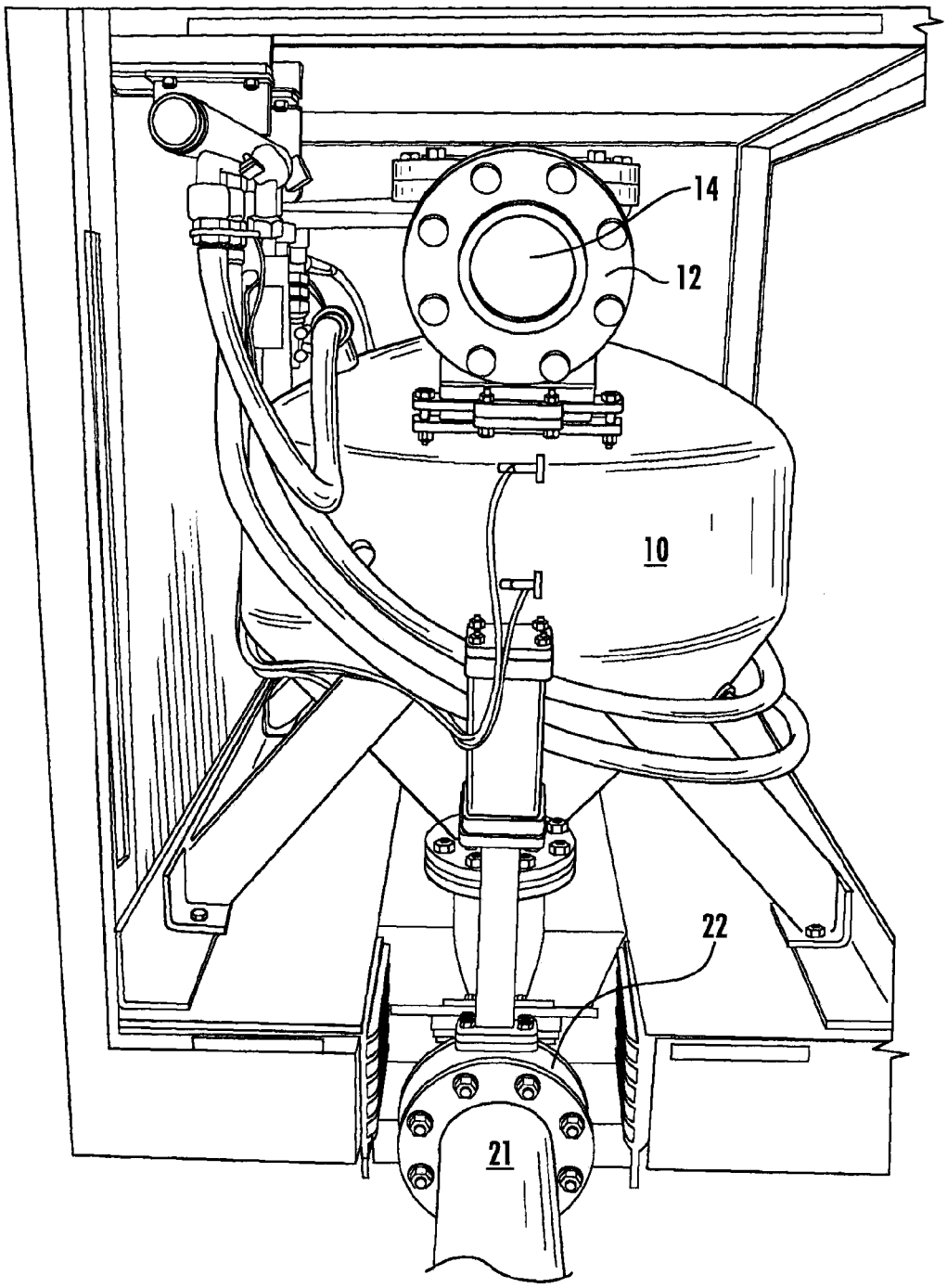
FIG. 10 is an opposite end perspective view of the apparatus of FIG. 9.

In the FIGS. 1 to 4, there is provided a pump with no moving parts if it is considered that during its operation nothing moves. Only when the cycle is change from suction to discharge are valves operated. The pump consists of a pressure vessel 50 with three openings or nozzles. Nozzle 51 is the inlet, where the product gets into the vessel during vacuum generation and is connected via a vacuum hose or pipe to a suction nozzle with an inlet knifegate valve 51' in between.

Nozzle 52 is where the vacuum is generated and is connected directly to an ejector. Nozzle 53 is where the product, once the pressure vessel has been filled, is evacuated by the use of compressed air, via an outlet knifegate valve 53'.

The inlet and outlet knifegate valves 51', 53' are mechanically operated in tandem by one pneumatic cylinder 60, whereby when one valve is closed, the other is open and vice-versa, meaning that when the cycle is suction the inlet valve 51' is open and the discharge valve 53' is closed. An ejector valve is located after the ejector is open allowing the ejector to create vacuum and generate air flow through the vessel. The air from the ejector is introduced into the discharge line after closure of the outlet valve 53', this air finishing the conveying of any product being left over inside during the previous discharge cycle and leaves a clean discharge line ready for the next blow.

When the cycle is in discharge the inlet knifegate valve 51' is closed, the outlet knifegate valve 53' is open and the ejector valve is closed. By closing the ejector valve the ejector does not function as such and diverts the compressed air into the vessel impelling the product out of it through the outlet valve 53'

Timers 64 control the length of each cycle. These timers 64 are pneumatically operated and need to be adjusted according to the properties and behaviour of the product to be transported.

The length of the suction cycle is determined by the product properties and distance from the suction nozzle to the pressure vessel. The greater the distance, the longer the cycle.

Once the pressure vessel is full the discharge cycle commences and again the length of this is determined by the product properties and the distance from the vessel to the discharge point, the greater the distance, the longer the cycle.

Pumps in accordance with the second embodiment are particularly adapted for use in the transporting of products where the centrifugal, positive displacement or diaphragm fails for one reason or another. They are utilised in the mining sector to clean drain pits. One good example is in the coal mining where diaphragm pumps don't last due to the seals leaking because particles stayed on the seats.

Drilling rigs in the ocean may use these pumps to move the separated tailings from the screens onto containers so they can be disposed in an environmentally friendly way.

They may be used in the cleaning of sediments of tanks, cleaning of digesters in water treatment plants, cleaning of settling ponds where the sediment becomes heavy and thick slurry.

In the FIGS. 5 to 10, there is provided a housing 10 in the form of a pressure vessel with two inlet openings 11 and 12. The inlet opening 11 is a gravity feed entry (blanked off and inoperable in this illustration), although the feed may be induced into the vessel under a slight vacuum. Inlet 12 is connected via a vacuum hose or pipe to a suction nozzle 13 which has a 25" Hg vacuum applied together with the full force of the induced airflow. The inlet 12 is controlled with knifegate valve 14 to control the flow.

A vacuum ejector 16 is fitted and is controlled by both a valve 17 on the air supply side and a knifegate valve 20 which seals the vessel when in the pressure or discharge cycle.

An outlet 21 is provided where the product exits the pressure vessel controlled by a knifegate valve 22 Valves 14, 17, 20 and 22 are mechanically operated with one pneumatic cylinder each. When the cycle is suction, the inlet and ejector valves are open and the discharge valve is closed, valve 22 located after at the bottom of the tank is opened allowing the product to exit through an enclosed pipeline up to 1000 meters from the vessel. The system allows for the recovered product to be delivered down the pipeline in both dense and lean phase depending on the distance and the physical properties of the product.

Timers control the length of each cycle. These timers are pneumatically operated and need to be adjusted according to the properties and behaviour of the product to be transported.

The length of the suction cycle is determined by the product properties and distance from the suction nozzle to the pressure vessel. The greater the distance and the less viscous the product the longer the cycle needs to be.

Once the pressure vessel is full the discharge cycle commences and again the length of this is determined by the product properties and the distance from the vessel to the discharge point, the greater the distance, the longer the cycle.

The apparatus in accordance with the foregoing embodiment is particularly adapted for the collection and transfer of drill cuttings generated by offshore drill rigs in the oil and gas exploration industry. The cuttings produced in the drilling process are carried back to the rig suspended in the "drill mud"; this is then recovered to be reused, with several techniques employed, the most common being passing the returning mud over a series of shaker screens. The remaining cuttings have several characteristics which make them difficult or even impossible to handle with standard pumps, these include a coating of the drill mud, their temperature, around 90 degree centigrade out of hole and the coagulative effect rapid cooling has on them. Current handling methods include the recovery by vacuum, auger, pressure pot (dense phase) or even adding mud to make a pumpable slurry. The vacuum systems in use all generate their vacuum via an electrically driven blower, the cutting are recovered to a hopper with some systems utilising a rotary valve which allows the product to be dropped into a pressure pot and then discharged using dense phase to transfer the cutting to their container. The system allows for the vacuum to be generated on the same vessel that is pressurised to deliver the cuttings to their final destination prior to shipping back to shore. The advantage and therefore the difference between the present system and any other available system, be they single, or a combination of methods, is its size, the present system having the smallest footprint of any system available, and is by far the simplest. The systems unique ability to handle an extremely wide range or products ranging from the cuttings either wet or dry, to the drill mud in either oil or brine based make it a very versatile piece of offshore equipment.

Figure 13:
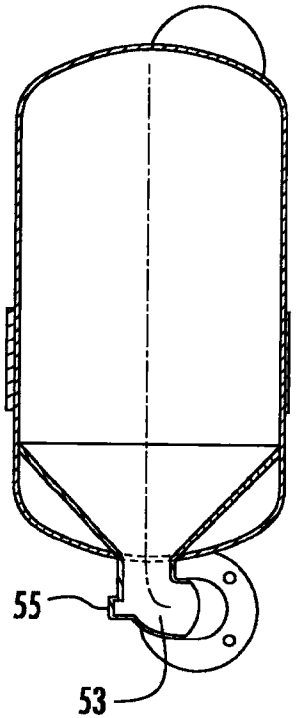
FIGS. 11 to 13 are views of an alternative, vertical vacuum/pressure tank second embodiment of the present invention.
Figure 12:
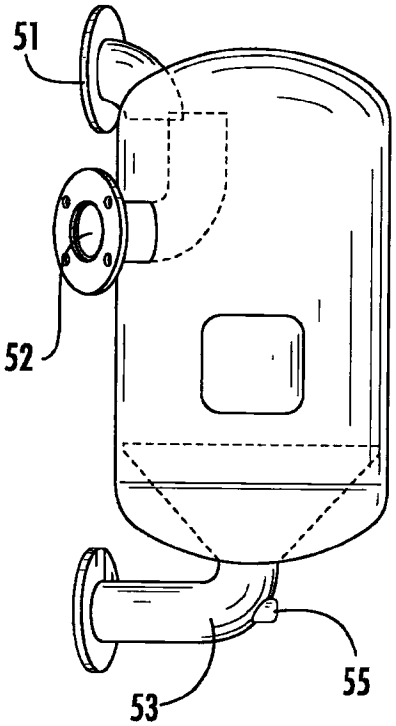
Figure 11:
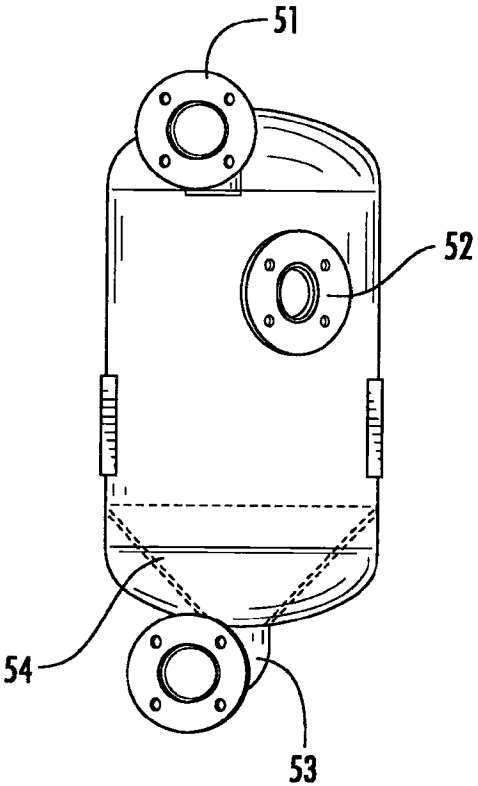

In the embodiment of FIGS. 11 to 13, the pressure vessel 50 is oriented vertically, and to maximize the benefit associated with this, an internal cone 54 has been fitted this aligns with the relocated discharge port 53 which is now in the centre of the dished end. There is also the addition of a small air inlet socket 55 which gives the option of educting the material from the tank on the discharge cycle. Secondly the internal neck of the ejector penetration 52 has been lengthened to ensure minimum carry over of product between the material inlet 51 and the air being evacuated via the ejector module fitted to 52.

Apart from these the functionality is identical to the previous embodiment; it utilizes exactly the same double acting knifegate valve and ejector module so the components are interchangeable. The vertical embodiment is capable of handling the same material and therefore can be utilized in the same applications as the previous embodiment, and with the vessel orientation being vertical allows for a much wider range in the moisture content of any material being recovered and transferred.

It will of course be realised that while the above has been given by way of illustrative example of this invention, all such and other modifications and variations thereto as would be apparent to persons skilled in the art are deemed to fall within the broad scope and ambit of the invention defined in the claims appended hereto.

The invention claimed is:

1. A pump apparatus including:

a housing having an inlet for admitting to the housing a material to be pumped, and a delivery outlet connected to a product line;

an inlet knifegate valve on the inlet;

an outlet knifegate valve on the outlet;

a common actuator mechanically interconnecting the inlet knifegate valve and the outlet knifegate valve to directly actuate the cyclic operation of the inlet knifegate valve and the outlet knifegate valve;

an ejector assembly having a compressed air driven venturi and an ejector valve after the compressed air driven venturi, the ejector valve being opened to reduce the pressure in the housing via the compressed air driven venturi to admit the material to the housing, and being closed to pressurize the housing, the waste air from the compressed air driven venturi being vented into the product line downstream of the knifegate outlet valve; and a controller operating the common actuator to actively open and close the inlet knifegate valve and the outlet knifegate valve in concert with the ejector valve.

2. The pump apparatus according to claim 1, wherein the controller is pneumatically operated.

3. The pump apparatus according to claim 1, wherein the common actuator and ejector valve are pneumatic in operation.

4. The pump apparatus according to claim 3, wherein the controller controls the amount of material admitted to the housing for each cycle by any one of an empirically determined time basis, metering by weight, or metering by volume.

5. A method of conveying product using the pump apparatus according to claim 1, wherein compressed air generates a vacuum via the ejector assembly and evacuates the air from the housing, opening the inlet knifegate valve to suck the product into the housing until the housing is charged, closing the inlet knifegate valve and the ejector valve blocking the compressed air driven venturi causing the compressed air to pressurize the housing, and opening the outlet knifegate valve to permit emptying of the housing.

6. A pump apparatus including:

a housing having an inlet for admitting to the housing a material to be pumped, and a delivery outlet to a product line;

a valve on each of the inlet and the outlet, the inlet and outlet valves being operable between an open position and a closed position;

an actuator actively actuating the inlet and outlet valves cyclically in response to signals from a controller; and an ejector assembly associated with the inlet and having a compressed air driven venturi and an ejector valve after the compressed air driven venturi being opened by the controller to reduce the pressure in the housing via the compressed air driven venturi and inlet to admit the material to the housing when the inlet valve is opened, and being closed by the controller to pressurize the housing to effect discharge from the housing when the outlet valve is open, the controller being adapted to close the inlet valve on admission of a selected charge of the material to the housing, the waste air from the compressed air driven venturi being vented into the product line downstream of the outlet valve when the outlet valve is closed.

7. The pump apparatus according to claim 6, wherein the actuator and the ejector valve are pneumatic in operation.

8. The pump apparatus according to claim 6, wherein the controller is pneumatically operated.

9. The pump apparatus according to claim 8, wherein the actuator and the ejector valve are pneumatic in operation.

10. The pump apparatus according to claim 9, wherein the controller controls the amount of material admitted to the housing for each cycle by any one of an empirically determined time basis, metering by weight, or metering by volume.

11. A pump apparatus including:

a housing having an inlet for receiving a material to be pumped, and an outlet;

a valve on each of the inlet and the outlet, the inlet and outlet valves being mechanically interconnected by a common actuator to effect the simultaneous operation of the respective valves;

an ejector assembly having a venturi, the air ejector having an open configuration for reducing pressure in the housing via the venturi to admit the material to the housing, and a closed configuration for pressurizing the housing; and a controller for selectively operating the common actuator such that the common actuator actively opens and closes the inlet and outlet valves in concert with the ejector valve.

12. The pump apparatus of claim 11, wherein the common actuator operates to simultaneously open the inlet valve while closing the outlet valve, and to simultaneously close the inlet valve while opening the outlet valve.

13. The pump apparatus of claim 11, wherein in internal neck of the ejector assembly within the housing is positioned above the housing inlet to minimize carry over of material between the inlet and the ejector assembly.

14. The pump apparatus of claim 11, further comprising an air inlet socket connected to the outlet.

15. The pump apparatus of claim 11, wherein the inlet and outlet valves are knifegate valves.

16. A pump comprising:

a housing defining an inlet, an ejector nozzle, and an outlet;

an inlet valve coupled to the inlet and moveable between an open position and a closed position;

an outlet valve coupled to the outlet and moveable between an open position and a closed position;

a source of pressure in communication with the ejector nozzle and configured to provide one of positive pressure and negative pressure to the housing through the ejector nozzle;

an actuator coupled between the inlet valve and the outlet valve and arranged to directly actuate both the inlet valve and the outlet valve such that when the inlet valve is in the open position, the outlet valve is in the closed position and alternatively, when the inlet valve is in the closed position, the outlet valve is in the open position; and a controller operating the actuator and the source of pressure to operate the pump.

17. The pump of claim 16, wherein the inlet valve is a knifegate valve and the outlet valve is a knifegate valve.

18. The pump of claim 16, wherein the actuator is pneumatically operated.

19. The pump of claim 16, wherein the actuator is a pneumatic cylinder mechanically interconnected with the inlet valve and the outlet valve.

20. The pump of claim 16, wherein the source of pressure includes a venturi.

21. The pump of claim 20 wherein the venturi vents waste air downstream of the outlet valve when the outlet valve is in the closed position.

22. The pump of claim 16, wherein the controller includes timers that control cycling of the actuator.

23. The pump of claim 22, wherein the timers are adjusted according to properties and behavior of a material to be pumped.

24. The pump of claim 16, wherein the controller is pneumatically operated.

* * * * *